US005918456A

United States Patent [19]

Darcis

[11] Patent Number: 5,918,456

[45] Date of Patent: Jul. 6, 1999

[54] DRAFTING FRAME FOR A TEXTILE MACHINE

[75] Inventor: Gerhard Darcis, Wiesensteig, Germany

[73] Assignee: Zinser Textilmaschinen GmbH, Ebersbach/Fils, Germany

[21] Appl. No.: 08/982,110

[22] Filed: Dec. 1, 1997

[30] Foreign Application Priority Data

Dec. 13, 1996 [DE] Germany ..... 196 52 062

[51] Int. Cl.[6] ..... D01H 5/28

[52] U.S. Cl. ..... 57/315; 19/244; 19/248; 19/249; 19/252; 19/253

[58] Field of Search ..... 57/315; 19/244, 19/248, 249, 250, 252, 253

[56] References Cited

U.S. PATENT DOCUMENTS

| | | | |
|---|---|---|---|
| 3,417,633 | 12/1968 | Robinson | 19/244 |
| 4,656,695 | 4/1987 | Lattner | 19/253 |
| 5,042,112 | 8/1991 | Stahlecker | 19/253 |
| 5,335,397 | 8/1994 | Stahlecker | 19/244 |
| 5,689,858 | 11/1997 | Hauner et al. | 19/262 |

FOREIGN PATENT DOCUMENTS

| | | | |
|---|---|---|---|
| 2310105 | 9/1974 | Germany | 19/253 |
| 242243 | 1/1987 | Germany | 19/244 |
| 3716864 | 12/1988 | Germany | 19/253 |
| 41 22 881 | 1/1993 | Germany . | |
| 4122881 | 1/1993 | Germany . | |
| 44 01 880 | 7/1995 | Germany . | |
| 4401880 | 7/1995 | Germany . | |
| 29708246 | 8/1997 | Germany . | |
| 58-197321 | 11/1983 | Japan . | |

*Primary Examiner*—William Stryjewski
*Attorney, Agent, or Firm*—Herbert Dubno

[57] ABSTRACT

A rail for supporting and guiding the lower belt of a drafting frame of a textile machine is provided with a coating of one or more of aluminum oxide, titanium dioxide, chromium oxide or molybdenum oxide in an oxide ceramic powder with a hardness of 800 to 1500 HV and a grain size of 45 to 5 $\mu$m. A pressing arm urges the stand against its belt.

9 Claims, 1 Drawing Sheet

DRAFTING FRAME FOR A TEXTILE MACHINE

FIELD OF THE INVENTION

My present invention relates to a drafting frame for a textile machine, and more particularly, to a drafting frame for a textile machine such as a ring spinning machine or a roving frame in which the drafting frame has a lower belt guided over at least one roller and at least one support rail.

BACKGROUND OF THE INVENTION

In textile machines such as spinning machines, roving frames and the like, especially ring spinning machines in the case of spinning machines, the drafting frame which is utilized for drawing the yarn, roving, slubbing or sliver, can include a lower belt against which the yarn is pressed by the upper belt of the pressing arm of the drafting frame.

This lower belt can pass around at least one roller which can be used to drive the lower belt and can have an upper pass guided by and supported by a guide rail about which the lower belt is deflected to form the return pass or stretch. This guide rail thus supports the upper stretch of the lower belt in the region in which it engages the strand to be drafted, and serves as the turning edge about which the upper stretch passes to form the return stretch. Hence, the guide rail can also be referred to as a deflection or return rail.

In many cases the lower belt, which passes around the drive roller and the guide rail, can be engaged by a tensioning stirrup which is spring loaded and serves to maintain a more or less constant tension on the lower belt. The tension on this lower belt can be adjustable by rotation of a rod in bores of which, shanks of the stirrups can engage.

DE 44 01 880 A1 describes a short roller belt for a drafting frame of this type which passes about a roller and a guide rail. The guide rail is composed of sheet metal and the return stretch is additionally guided as it passes off from the edge of this guide rail.

A belt table is formed in the drafting frame of DE 41 22 881 A1 which has a formation with surfaces extending to opposite sides of this formation. The formation is engaged formfittingly in a slide guide arrangement and a pivotal movement can be imparted to the table plate.

The plate and the formation can be comprised of a plastic.

It is also known to treat the surface of a guide rail of the type described so as to reduce the wear of the surface where it is engaged by the belt, e.g. by zinc plating, chromium plating or coating with an epoxy resin lacquer.

OBJECTS OF THE INVENTION

It is the principal object of the present invention to provide an improved drafting frame for a textile machine which has a reduced wear of the lower belt guide rail and increased use or life thereof by comparison with earlier drafting frames.

Another object of the invention is to provide an improved drafting frame which avoids drawbacks of earlier systems.

SUMMARY OF THE INVENTION

These objects and others which will become apparent hereinafter are attained, in accordance with the present invention, in a drafting frame for a textile machine of the type described, wherein the roller belt, e.g. of rubber with or without reinforcement, passes over a guide rail having a surface supporting the belt in its upper stretch, at in at least one roller about which the upper belt passes, the guide rail serving as a turning rail about which the belt returns to the return stretch thereof. According to the invention, at least the upper metal surface of the guide rail is provided with an oxide-ceramic powder coating which consists of at least one oxide ceramic metal compound, for example aluminum oxide ($Al_2O_3$), titanium dioxide ($TiO_2$), chromium oxide ($Cr_2O_3$) or molybdenum (VI)-oxide ($MoO_3$) or mixtures of oxide ceramic metal compounds.

I have found that such a power coating on the surfaces contacted by the belt of such a guide rail can greatly reduce the wear of the guide rail itself and thus significantly increase its useful life, at least in part because the oxide ceramic powder coating appears to have a reduced friction against the belt, can avoid creasing of the belt or the application of forces thereto which might interfere with the smooth running thereof, and prevents damage to the belt between the belt drive roller and the rail. As a consequence, yarn quality is positively affected.

It is indeed surprising that oxide ceramics, which are known in other applications to have abrasive effects, can serve in the system of the present invention to reduce friction and wear of the guide rail and insure smooth running of the belt.

The application of the powder oxide in ceramic coating to the metal surface of the guide rail can be effected by any conventional technique which has been used to deposit oxide ceramic material in a powder coating. It can therefore include thermal spray processes, for example, plasma spraying, flame-wire spraying, flame-powder spraying or even fluidized bed coating techniques. As far as I am aware, these coating techniques have not been used heretofore for the application of coatings to the metal surface, especially the belt-engaging metal surfaces of the guide or turning rails of a belt of a drafting frame in a textile machine.

According to a feature of the invention, only the surfaces of the guide rail engaged by the lower belt of the drafting frame are coated with the oxide ceramic in the manner described.

If the guide rail is of T-shaped cross section with a substantially horizontal shank over which the belt is guided, and a vertical shank or a shank perpendicular to the guiding shank, just the upper side of the horizontal or guide shank and the edges thereof which may be engaged by the belt, need be so coated.

The rail can also have an L-shape with an upper shank over the belt is guided and a shank perpendicular to this upper shank. In this case only the upper side of the upper shank and the edge about which the belt is deflected need be so coated in accordance with the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
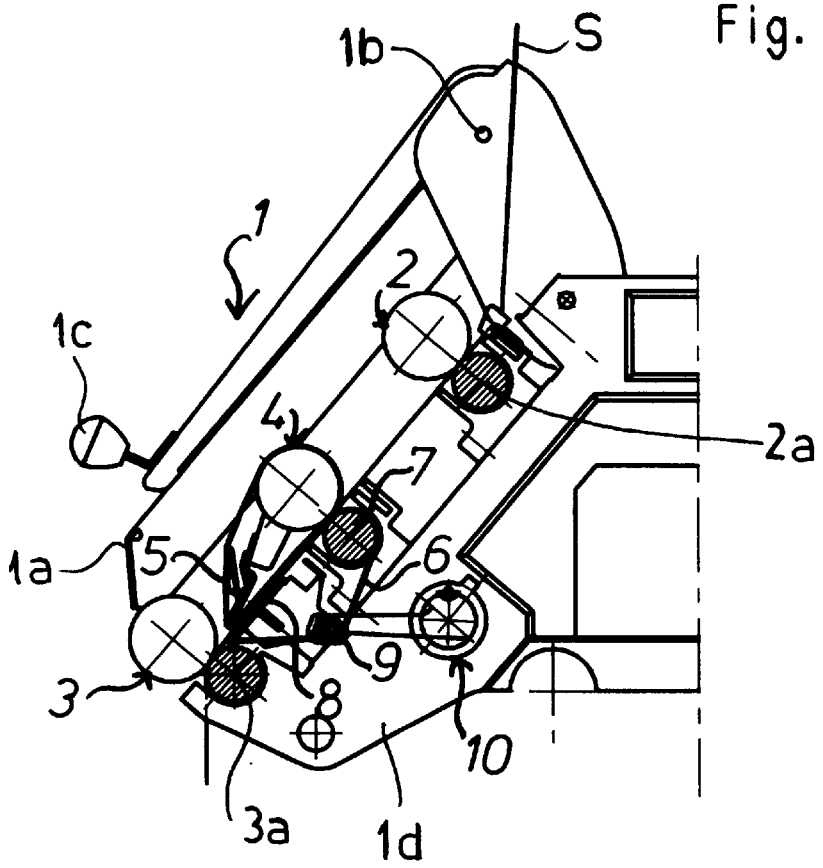
FIG. 1 is a vertical section through a textile machine having a drafting frame in accordance with the invention, showing the lower belt and a tensioning stirrup for the lower belt.

FIG. 1 shows a drafting frame 1 of a textile machine, which can be used for a roving frame or a ring spinning frame or the like and which comprises an arm 1*a* which can be swung about a pivot 1*b* by a handle 1*c* and which carries the upper rollers 2, 3 and 4. The roller 4 derives an upper belt 5 on the arm 1*a* which can press the roving, slubbing or yarn S against the lower roller 2*a* and the lower roller 3*a* on a support 1*d* of the drafting frame.

The rollers 2 and 2*a* form an input roller pair for the drafting frame while the rollers 3 and 3*a* form an output roller pair.

Between these two roller pairs, the upper belt 5 presses the strand against the lower belt 6 which is guided around the driven lower roller 7, a T-section guide rail 8, and a tensioning stirrup 9. The tensioning stirrup 9, in turn, can be displaced by a tensioning device 10, the adjustment of which controls the tension on the lower belt 6.

Figure 3:
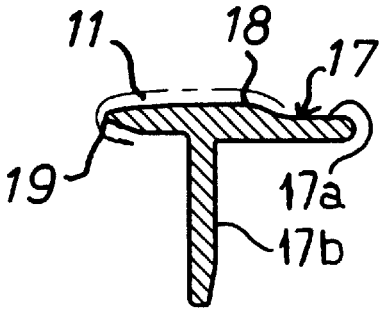
FIG. 3 is a cross sectional view of an L-section guide rail for the lower belt of the drafting frame of FIG. 1.

According to the invention, the guide rail 8 or the L-section guide rail of FIG. 3, are coated with an oxide ceramic powder coating 11 where they contact the belt 6, which can be composed of rubber reinforced with synthetic resin, glass or carbon fiber reinforcements. The powder coating 11 can be composed of a single oxide ceramic metal compound selected from the group which consists of aluminum oxide ($Al_2O_3$), titanium dioxide ($TiO_2$), chromium oxide ($Cr_2O_3$) or molybdenum (VI)-oxide ($MoO_3$). It can also comprise a mixture of different oxide ceramic metal compounds such as the following with the compositions given in percent by weight: $Al_2O_3$—$TiO_2$—(60%-40%); $Al_2O_3$—$TiO_2$—(87%-13%), $Al_2O_3$—$TiO_2$ (97%-3%).

Figure 2:
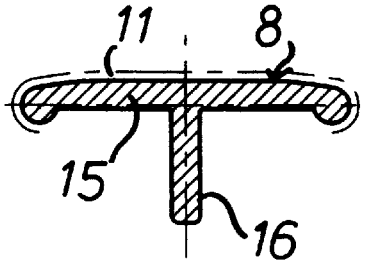
FIG. 2 is a cross sectional view through a T-section guide rail for the lower belt.

As FIGS. 1 and 2 show, the guide rail 8 can be of T-shaped cross section with the generally horizontal or contact shank 15 having a vertical or perpendicular shank 16. The guide rail can be composed of steel. In the embodiment of FIG. 2, only the upper surface of the horizontal shank 15 and at least one edge contacted by the endless belt 6 is provided with the oxide ceramic powder coating.

In FIG. 3 an approximately L-shaped guide rail 17 is provided with its shank 18 being contacted by the belt and provided with the coating 11 along with the edge 19. A setback portion 17*a*, which normally does not contact the belt, is not so coated. The rail has a shank 17*b* perpendicular to the shank 18.

The oxide ceramic powder coating is applied in a simple way, e.g. by plasma spraying and, even in a thickness of the order of 1 $\mu$m to 50 $\mu$m, enhances the life of the rail, reduces wear and improves the quality of the yarn.

In general the grain size of the deposited powder should range between 45±5 $\mu$m and the coating should have a hardness of 800 to 1500 HV.

I claim:

1. A drafting frame for a textile machine comprising:

a support, at least one lower belt assembly on said support including a drive roller, an endless belt passing around said drive roller and driven thereby, and a guide rail having a support surface beneath an upper pass of said belt and an edge around which said belt is deflected to a lower return pass of said belt; and a pressing arm with roller means for pressing a textile strand to be drawn against said belt, at least said surface of said rail having an oxide ceramic powder coating thereon.

2. The drafting frame defined in claim 1 wherein said oxide ceramic powder coating is applied only to portions of said rail contacting said belt.

3. The drafting frame defined in claim 1 wherein said rail has a T-section with a generally horizontal shank formed with said surface and another shank perpendicular thereto, said oxide ceramic powder coating being formed on said horizontal shank and at least one edge thereof.

4. The drafting frame defined in claim 1 wherein said rail is generally of L-section with a horizontal shank and vertical shank, said horizontal shank having an upper surface contacting said belt and provided with said coating.

5. The drafting frame defined in claim 1 wherein said oxide ceramic powder coating is a coating of a single metal oxide selected from the group which consists of aluminum oxide, titanium dioxide, chromium oxide or molybdenum (VI)-oxide.

6. The drafting frame defined in claim 1 wherein said oxide ceramic powder coating is a coating of a mixture of metal oxides selected from the group which consists of aluminum oxide, titanium dioxide, chromium oxide and molybdenum (VI)-oxide.

7. The drafting frame defined in claim 6 wherein said oxide ceramic powder coating is a coating containing at least one of aluminum oxide and titanium dioxide.

8. The drafting frame defined in claim 1 wherein said oxide ceramic powder coating is in the form of grains with a grain size of 45±5 $\mu$m.

9. The drafting frame defined in claim 1 wherein said oxide ceramic powder coating has a hardness of 800 to 1500 HV.

* * * * *